United States Patent [19]

Ward, Jr.

[11] 4,009,877

[45] Mar. 1, 1977

[54] DOCUMENT TRANSPORT DEVICE

[75] Inventor: John Wesley Ward, Jr., Pflugerville, Tex.

[73] Assignee: International Business Machines Corporation, Armonk, N.Y.

[22] Filed: Nov. 3, 1975

[21] Appl. No.: 627,984

[52] U.S. Cl. ..... 271/272; 271/264; 226/171

[51] Int. Cl.[2] ..... B65H 29/16

[58] Field of Search ..... 271/272–275, 271/198, 205, 264, DIG. 2; 198/160; 226/171

[56] References Cited

UNITED STATES PATENTS

| | | | |
|---|---|---|---|
| 1,786,343 | 12/1930 | Griffith | 271/198 |
| 1,962,713 | 6/1934 | Griffith | 198/160 |
| 2,069,716 | 2/1937 | Beardsley et al. | 198/160 |
| 2,899,201 | 8/1959 | Pirot | 271/272 |
| 3,287,013 | 11/1966 | Fairbanks et al. | 271/272 |
| 3,804,401 | 4/1974 | Stange | 271/DIG. 2 |

OTHER PUBLICATIONS

McDaniels, "Simplified O-Ring Document Transport"; IBM Technical Disclosure Bulletin; vol. 17, No. 12; May 1975 p. 3507.

*Primary Examiner*—Robert W. Saifer
*Attorney, Agent, or Firm*—John L. Jackson

[57] ABSTRACT

Disclosed is document transport apparatus for advancing documents between two locations, for example between the printing and output stations of copying equipment, the transport apparatus including a high friction continuously driven belt cooperating with a stationary strip of low friction material to define a transport guideway path for the documents with document pinch points being defined along spaced locations of the guideway path. The continuous belt is preferably of a cross-sectional size and configuration to transportably engage the documents along a line contact at, or immediately adjacent, the edge thereof.

3 Claims, 4 Drawing Figures

DOCUMENT TRANSPORT DEVICE

The present invention relates to document transport apparatus, more particularly to apparatus employed in printing equipment for advancing documents from the print station to the output stacker, and even more particularly to high speed, low inertia, document transport apparatus for transportably engaging a document outside of the printed area of the document.

In many applications, such as data processing, card sorting, photocopying, etc., it is necessary to achieve the rapid and effective transport of documents between the various processing stations. For example, in the case of copying equipment, it is imperative that a document transport assembly be employed which rapidly conveys documents from the print station to the stacker or collator at the output of the equipment in a manner which does not impede the overall throughput of the equipment. Prior art transport mechanisms have typically involved not only relatively high inertia transport assemblies, but such assemblies normally engage the documents along their major face or at the trailing or leading edges thereof. Thus, not only has there been a consequent reduction in transport time, but where the printing of the documents is carried out by a liquid printing process, the documents cannot be immediately transported from the printing station until sufficient time has passed to allow the ink or print copy to dry. Furthermore, the location of the stacking or collating equipment with respect to the printing station often requires that the transported document undergo a reversal in transport direction, which becomes difficult with present assemblies.

In addition to the aforementioned requirements, any type of document transport apparatus, particularly that employed with copying equipment, should provide a convenient method for extracting the documents from the transport assembly in the event of jamming or other malfunction of the equipment. In prior art apparatus, however, attempted extrication of the documents often results in the documents tearing or becoming fouled with the transport equipment itself.

It is therefore a principal object of the present invention to provide a new and improved document transport apparatus.

It is another object of the invention to provide new and improved apparatus for rapidly transporting documents by way of a low inertia transport assembly which not only effectively grips each of the documents during their transport, but allows for convenient extrication of the documents from such assembly.

It is another object of the invention to provide a new and improved method and apparatus for rapidly transporting documents from the printing station of copying equipment of the stacking or collating station at the output of such equipment.

It is an even still further object of the present invention to provide for the effective transport of documents which have been printed in accordance with a liquid printing process in a manner which avoids contact with the printed portion of the documents during their transport.

It is an even still further object of the invention to provide document transport apparatus achieving the aforementioned objectives and which can be fabricated and assembled with minimum time and expense.

In accordance with these and other objects, the present invention is directed to document transport apparatus for advancing documents along a transport path defined by a continuously movable belt and a cooperating backing support member, the belt being effective to frictionally engage the documents and slidably advance them along the backing support member, thereby effectively and rapidly transporting the documents through the assembly. More specifically, the continuously driven belt, which is of high coefficient of friction material, cooperates with the lower coefficient of friction backing support to define document pinch points at spaced locations along the transport path and is of a cross-sectional shape and size to transportably engage the document along an essentially line contact at or immediately adjacent the longitudinal edge of the document. In a preferred form of the invention, the backing support strip is configured to define the pinch points at areas between the pulleys around which the belt is disposed, thus enabling the convenient extraction of the documents from the transport assembly when desired.

Additional features of the invention, as well as further objects and advantages thereof, will become readily apparent from the following detailed description, taken in conjunction with the accompanying drawings in which.

Figure 2:
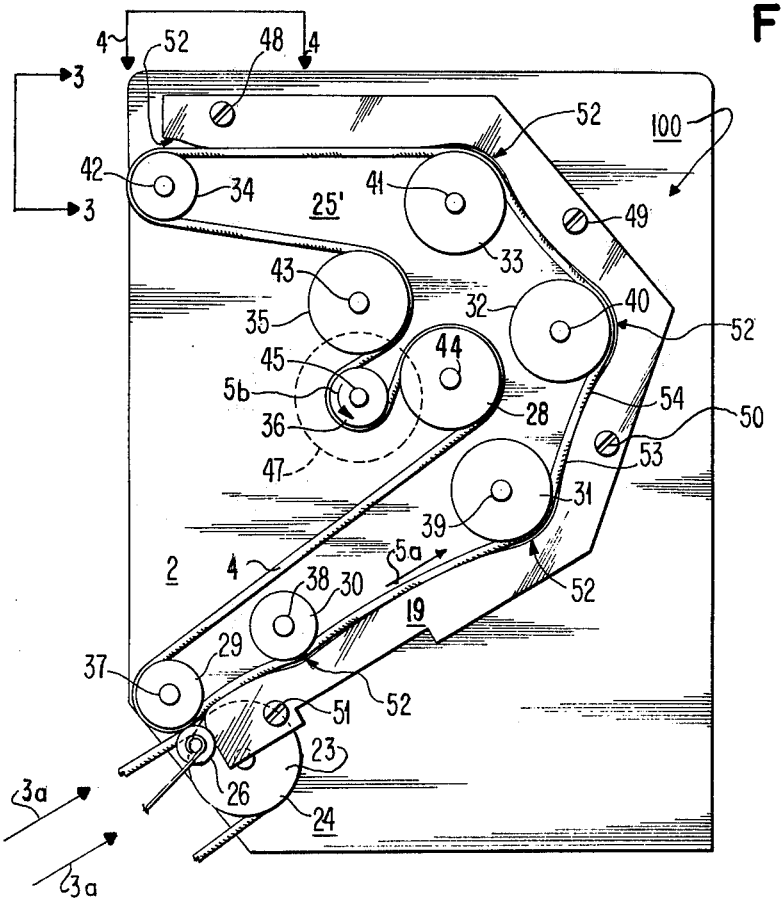
FIG. 2 is a side elevation of the document transport apparatus of the present invention illustrating additional features of the apparatus, as well as an alternate embodiment thereof.
Figure 3:
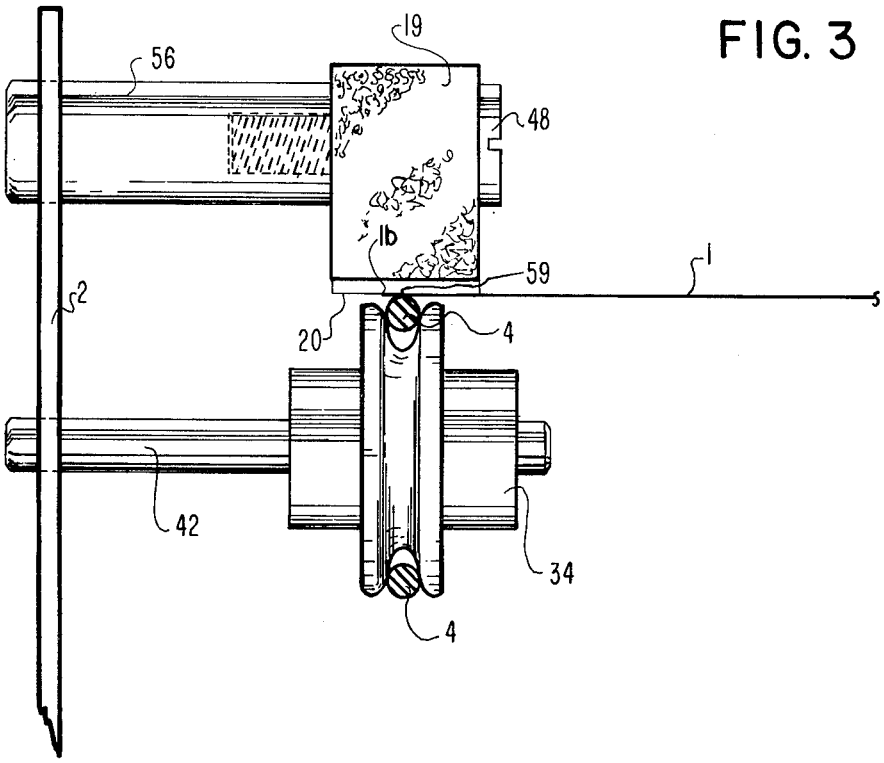
Figure 4:
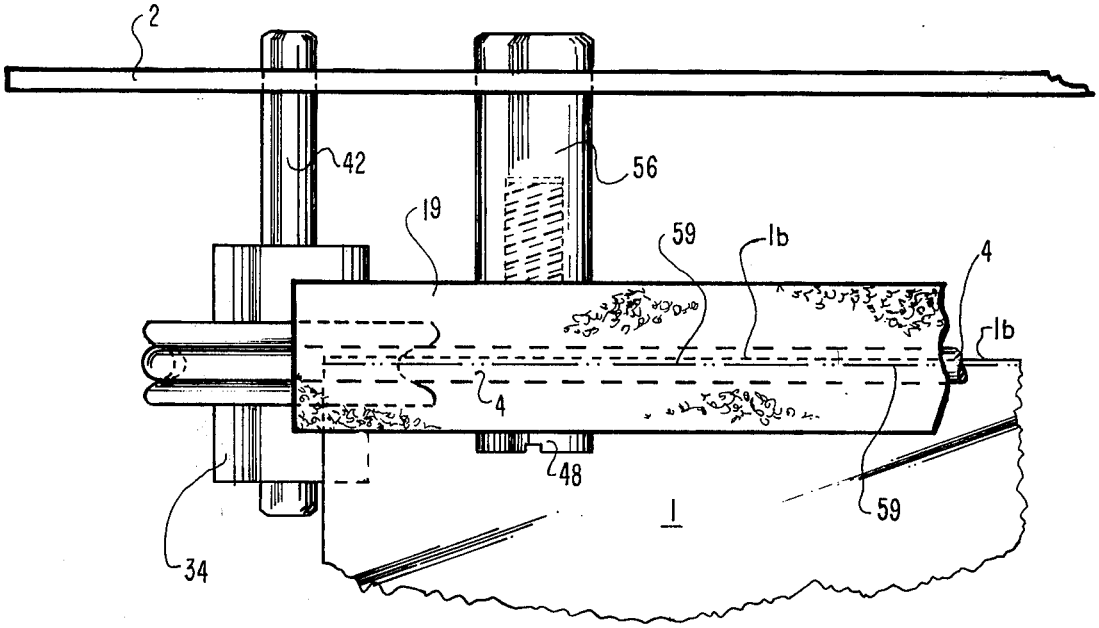

FIG. 3 is an enlarged pictorial view of a portion of the apparatus depicted in FIG. 2, taken along the line 3—3 and looking in the direction of the arrows, specifically illustrating the line contact engagement of the belt with the document and backing support; and FIG. 4 is an enlarged pictorial view of a portion of the apparatus depicted in FIG. 2, taken along the line 4—4 and looking in the direction of the arrows, specifically illustrating the line contact engagement of the belt with the document and backing support.

The drawings are not necessarily to scale, and in some instances portions have been exaggerated in order to emphasize particular features of the invention.

Figure 1:
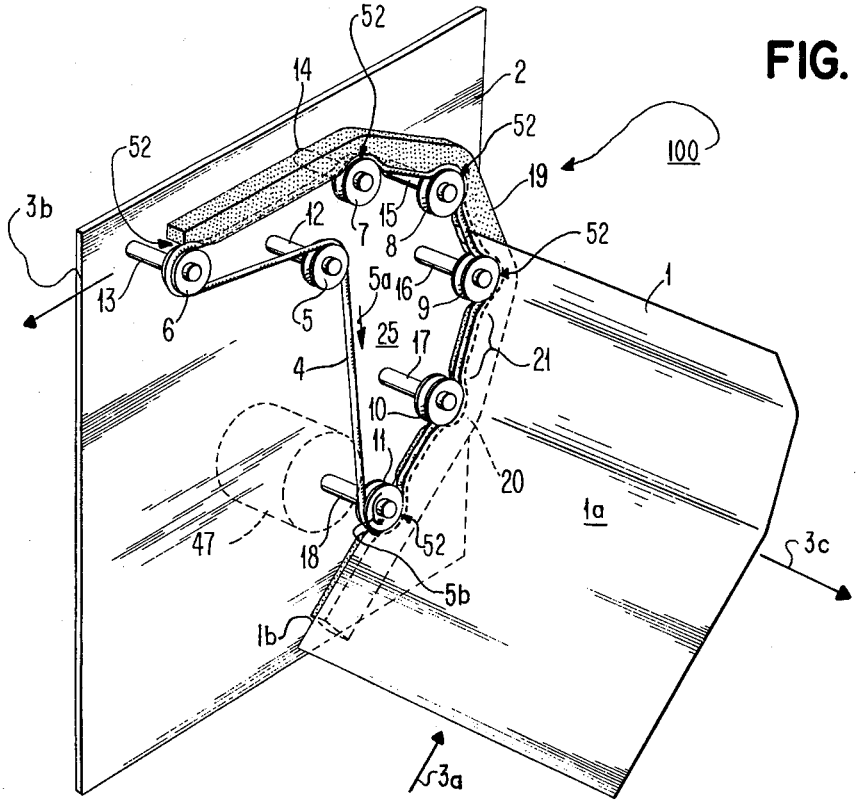
FIG. 1 is a pictorial illustration of a first preferred embodiment of the document transport apparatus of the present invention, depicted in conjunction with a document being advanced along the transport path.

Referring initially to FIG. 1, the document transport apparatus of the present invention is broadly represented by the reference numeral 100 and is depicted as transporting a document 1 which enters the apparatus in a direction indicated by arrow **3*a* and exits the transport apparatus in the direction indicated by arrow 3*b*. As used throughout the present description, the term "documents" means and refers to sheet like articles of a generally flexible nature; and would include, for example, paper, envelopes, cards, and the like. In accordance with a specific application of the transport apparatus 100, the document 1 illustrated in FIG. 1 constitutes a sheet of paper which has exited the print station of copying equipment (not shown) in direction 3*a*, the paper having been printed upon at least one of its major faces 1*a*. The paper is then transported through the apparatus 100 to be ejected (in direction 3*b*) into an output stacker or collator (not shown). As subsequently described in greater detail, the document 1, during transport, is engaged solely at a location at (or immediately adjacent) its longitudinal edge 1***b*. This is particularly advantageous where the face 1*a* is printed in accordance with a liquid printing process since transport of the document solely at the edge avoids smearing the print copy which may not have dried sufficiently prior to the document entering the transport apparatus.

In accordance with a first preferred embodiment of the invention depicted in FIG. 1, the document transport apparatus comprises a drive train assembly 25 composed of a continuous belt 4 wrapped around and frictionally engaging a drive pulley 11 and a plurality of idle pulleys 5–10. Drive pulley 11 is rigidly connected for rotation with a drive shaft 18 which is rotatably driven (in direction of arrow 5*b*) by a conventional motor 47, while idle pulleys 5–10 are adapted to rotate freely with respect to respective stationary shafts 12–17 which are secured in any suitable manner with a mounting plate 2.

Disposed behind, but immediately adjacent, the pulleys 6–11 is a backing support member 19 which, in cooperation with the adjacent pulleys, defines a guide or transport path along which the document 1 is transported from where it enters the transport apparatus from the print station until it is ejected (in the direction of arrow 3*b*) to the output stacker or collator. Actuation of the motor 47 then advances the continuous belt 4 in the direction designated by arrow 5*a;* and documents 1 which have been moved into position between the belt 4 and the backing support 19 (adjacent the pulley 11) are consequently transported by the belt 4 in the manner subsequently described along this transport path until they exit the apparatus at the location of the pulley 6. By disposing the outer pulleys 6–11 in the curved pattern depicted in FIG. 1, and by constraining the backing support member 19 to follow the contour of this pattern, an approximate semi-circular transport path is defined and the consequent direction of travel of each of the documents 1 is essentially reversed through the document transport apparatus to enable the documents to be ejected in the direction 3*b*, the length of the transport path (and transport speed) being sufficient to allow the print copy on the surface 1*a* to dry during document transport.

Various devices may be used for the backing support member 19, the essential requirements being that such device cooperate with the moving belt 4 to define pinch points at various locations along the transport path to enable the belt 4 to frictionally engage the documents at these pinch points in order to advance each document along the transport path. Additionally, the device 19 must not inhibit the movement of each document along its interior surface. For example, the member 19 could constitute a stationary flat belt which is wrapped around or disposed immediately adjacent pulleys 6–11 and is thus effective to define the pinch points at the situs of each pulley. In accordance with a unique feature of the present invention, and as depicted in the drawings, the backing member 19 is formed as a solid strip of material having a sufficiently low coefficient of friction (for example, in the order of 0.1) which enables each document to readily slide along its surface, and for this purpose may be composed of a material such as is sold under the trademark Teflon or Delrin. In addition, the strip 19, which is rigidly secured to plate 2, has its interior surface 20 recessed at the situs of each pulley (indicated at locations 52) to provide clearance between the belt 4 and surface 20 at each of these locations. Thus, the document pinch points occur not at the pulley situs, but rather in the areas between adjacent pulleys (one such area being designated by the numeral 21).

By using a low friction strip as the backing support member 19 in the configuration just described, a number of advantages are realized. First, since the document pinch points are essentially spread over a larger area (21) between the pulleys, rather than being concentrated at the pulleys, the document gripping pressure is substantially reduced. Thus, a document can be easily extricated from the transport apparatus in the event of malfunction or paper jamming by pulling the document in the direction indicated by arrow 3*c*. Additionally, critical tolerances are not required between the document transport belt 4 and the rigid strip 19 since clearance is provided at the situs of the pulleys, and the inherent flexibility of the belt 4 can compensate for irregularities in the surface of the strip in the document pinch point areas 21. Finally, the strip 19 can be inexpensively fabricated and easily assembled.

Additional features of the document transport apparatus 100, as well as an alternate embodiment of the drive train assembly thereof, are depicted in FIG. 2. Accordingly, and in a manner similar to that previously described, the drive train assembly 25' comprises the continuous document drive belt 4, a plurality of idle pulleys 28–35 (freely rotatable with respect to support shafts 37–44), and a centrally disposed drive pulley 36 which is rotatably driven in the direction of arrow 5*b* by the drive shaft of the motor 47, the drive belt 4 thus being continuously advanced in the direction of arrow 5*a*. The low friction strip 19 is secured in place by way of screws (48–51) threadably inserted in stand-offs 56 connected to mounting plate 2 (FIGS. 3 and 4) so that, as before, the surface 20 of strip 19 conforms to the arrangement of idle rollers 29–34 to define the desired transport path for the documents 1. Additionally, an alignment and feed assembly is illustrated (generally depicted by the reference numeral 24 and including cooperating pulleys 23 and 26) which is effective to feed each document which exits the printer (in the direction of arrow 3*a*) into the apparatus 100 and initially align the left edge of the document into the transport path. The specific details and operation of the assembly 24 are not described herein since they do not form a part of the present invention, it only being important to point out that such assembly (or any other type assembly) be effective to feed and align the documents at the entrance to apparatus 100 in the manner previously described.

The continuous belt 4 is formed of a material having a relatively high coefficient of friction (preferably in excess of 0.7) so as to enable the transport of each document along the defined transport path as a consequence of the belt's substantial frictional engagement with each document in the pinch point regions 21. In accordance with a significant feature of the present invention, the belt 4 is of a circular cross-section having a sufficiently small diameter (for example ⅛ of an inch) to enable an essentially line contact at the intersection of the document advance belt 4 and the document 1 as the latter is slidably transported along the low friction surface 20 of the backing strip 19. As a consequence, and as best depicted in FIGS. 3 and 4, each document may be transportably engaged at, or immediately adjacent, the edge 1*b* of the document, the line contact at such location being indicated by the reference numeral 59.

Thus, the document transport apparatus incorporating the features of the present invention enables the documents to be effectively transported from the printing station to the stacker with each document being engaged solely along a longitudinal edge thereof. This not only avoids smearing the print copy during transport, but enables the transport direction to be reversed without having to transfer the documents between feed roller sets. Furthermore, the cooperative relationship between the flexible high friction belt 4 and the rigid low friction strip 19 establishes a guide path for transport of documents of various widths, provides effective pinch points to enable transportable engagement by the belt, but still allows for the convenient extraction of a document from the transport apparatus, if necessary.

In addition, the use of a single continuous driven belt in the manner described provides a lower inertia (and thus high speed) method for advancing each document along the transport path, removes the constraint on the length of document that can be transported (which in the case of cooperating feed rollers would be determined by the spacing between roller sets), and thus consequently reduces the propensity of documents being jammed within the apparatus. Thus, the transport apparatus of the present invention enables documents to be effectively and rapidly ejected into an output collator or stacker as the trailing edge of each document virtually flies by the final pulley (6 or 34) as it exits the transport path.

Various modifications to the disclosed embodiments, as well as alternate embodiments, may become apparent to one skilled in the art without departing from the spirit and scope of the invention as defined by the appended claims.

What is claimed is:

1. Document transport apparatus, comprising:

a. a drive train assembly comprising a plurality of idle pulleys, a belt of relatively high coefficient of friction material disposed around said pulleys, and means for continuously advancing said belt along a transport path from a single document entry location to a document exit location defined by said pulleys, and b. a rigidly mounted strip of material having a low coefficient of friction, said strip having a principal surface following the contour of, and cooperating with, said belt to define a guideway for documents advanced along said transport path, said principal surface having first surface portions recessed from said pulleys and said second surface portions intermediate said pulleys immediately adjacent said belt defining document pinch points, whereby documents aligned within said guideway are transportably engaged by said belt at said pinch points and are substantially released from said engagement at the location of said first recessed surface portions.

2. The document transport apparatus as defined by claim 1 wherein said belt is of a circular cross-section of sufficiently small diameter to engage said documents at an essentially line contact therewith at said pinch points.

3. The apparatus as defined by claim 2 wherein said belt engages said documents solely at an edge thereof.

* * * * *